US008361690B2

(12) United States Patent
Sakaguchi et al.

(10) Patent No.: US 8,361,690 B2
(45) Date of Patent: Jan. 29, 2013

(54) TONER FOR DEVELOPING ELECTROSTATIC LATENT IMAGE, DEVELOPER INCLUDING THE TONER, AND IMAGE FORMING METHOD AND IMAGE FORMING APPARATUS USING THE DEVELOPER

(75) Inventors: Yuka Sakaguchi, Numazu (JP); Hideki Sugiura, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 219 days.

(21) Appl. No.: 12/797,088

(22) Filed: Jun. 9, 2010

(65) Prior Publication Data

US 2010/0316948 A1 Dec. 16, 2010

(30) Foreign Application Priority Data

Jun. 11, 2009 (JP) ..... 2009-140257
May 14, 2010 (JP) ..... 2010-112184

(51) Int. Cl.
*G03G 9/093* (2006.01)

(52) U.S. Cl. ..... 430/109.4; 430/109.1; 430/110.2; 430/110.3; 430/110.4; 430/123.41; 399/222

(58) Field of Classification Search ..... 430/109.1, 430/109.4, 110.3, 110.4, 110.2, 123.41; 399/222
See application file for complete search history.

(56) References Cited

U.S. PATENT DOCUMENTS 7,163,773 B2 1/2007 Sugiura et al.
7,166,403 B2 1/2007 Ichikawa et al.
7,172,844 B2 2/2007 Umemura et al.
7,261,989 B2 8/2007 Sugiura et al.
7,318,989 B2 1/2008 Kotsugai et al.
7,368,212 B2 5/2008 Sugiura et al.
7,374,851 B2 5/2008 Nakayama et al.
7,405,000 B2 7/2008 Takikawa et al.
7,442,484 B2 10/2008 Uchinokura et al.
7,455,942 B2 11/2008 Nagatomo et al.
7,521,164 B2 4/2009 Nakayama et al.
7,547,497 B2 6/2009 Uchinokura et al.
7,566,521 B2 7/2009 Kotsugai et al.
7,608,377 B2 10/2009 Nakayama et al.
7,642,032 B2 1/2010 Sugiura et al.
7,664,439 B2 2/2010 Sugiura
2003/0190540 A1* 10/2003 Shoshi et al. ..... 430/78
2004/0142264 A1* 7/2004 Tanaka et al. ..... 430/108.4
2005/0058922 A1* 3/2005 Magome et al. ..... 430/106.1
2006/0024604 A1 2/2006 Sugiura et al.

(Continued)

FOREIGN PATENT DOCUMENTS

JP 2002-148866 5/2002
JP 2002-351139 12/2002

(Continued)

*Primary Examiner* — Peter Vajda
(74) *Attorney, Agent, or Firm* — Oblon, Spivak, McClelland, Maier & Neustadt, L.L.P.

(57) ABSTRACT

A toner for developing electrostatic latent images, including a binder resin; a colorant; and a release agent, wherein the toner has a glass transition temperature (Tg) of from 55 to 75° C., a melting point (T1/2) of from 95 to 125° C. as measured by a flow tester in a ½ method, and ΔTs of from 1 to 5° C., and wherein ΔTs is defined by the following formula:

$$\Delta Ts = Ts - T(Ls/2)$$

wherein Ts is a softening point of the toner; T(Ls/2) is a temperature when a stroke is Ls/2; and Ls is a stroke (mm) at Ts.

20 Claims, 6 Drawing Sheets

U.S. PATENT DOCUMENTS

| | | | | |
|---|---|---|---|---|
| 2006/0160011 | A1* | 7/2006 | Inoue et al. | 430/109.4 |
| 2008/0096116 | A1 | 4/2008 | Utsumi et al. | |
| 2008/0305423 | A1 | 12/2008 | Sugiura et al. | |
| 2009/0023090 | A1* | 1/2009 | Fujimoto et al. | 430/124.15 |
| 2009/0123186 | A1 | 5/2009 | Sugiura et al. | |

FOREIGN PATENT DOCUMENTS

| | | |
|---|---|---|
| JP | 2006-91648 | 4/2006 |
| JP | 2007-233169 | 9/2007 |
| JP | 2007-328206 | 12/2007 |
| JP | 4156468 | 7/2008 |
| JP | 2008-242473 | 10/2008 |
| JP | 4221319 | 11/2008 |
| JP | 4347174 | 7/2009 |

* cited by examiner

TONER FOR DEVELOPING ELECTROSTATIC LATENT IMAGE, DEVELOPER INCLUDING THE TONER, AND IMAGE FORMING METHOD AND IMAGE FORMING APPARATUS USING THE DEVELOPER

BACKGROUND OF THE INVENTION

1. Field of the Invention

The present invention relates to a toner for use in a developer for developing an electrostatic latent image in electrophotography, electrostatic recording, electrostatic printing, etc., and to a developer including the toner, an image forming method, and an image forming apparatus using the developer. More particularly, the present invention relates to a toner for developing an electrostatic image for use in (full-color) copiers, (full-color) laser printers, (full-color) plain paper facsimiles, etc., using direct or indirect electrophotographic (multicolor) developing methods, and to a developer including the toner, an image forming method, and an image forming apparatus using the developer.

2. Discussion of the Background

As U.S. Pat. No. 2,297,691 discloses, electrophotographic image forming methods typically include serial processes of forming an electrostatic latent image on a photoreceptor (electrostatic latent image bearer), developing the electrostatic latent image with a developer to form a visual image (toner image), transferring the visual image onto a recording medium such as paper, and fixing the image thereon.

Recently, in terms of saving energy, technologies capable of fixing at low temperature and copying at high speed have been developed, e.g., toners including a resin or a wax having a low softening point and having good low-temperature fixability. However, a toner having good low-temperature fixability is thermally vulnerable and likely to be solidified with heat generated by apparatuses or when stored (so-called blocking phenomena). Moreover, the toner has neither sufficient heat-resistant storage stability nor a sufficient fixable temperature band.

In order to make a toner have low-temperature fixability, thermal properties of a resin included in the toner need controlling. Thus, e.g., Japanese Patent No. 4,347,174 and Japanese published unexamined application No. 2007-233169 disclose including a melting miscible material having a plasticizing effect and compatible with a resin such as a crystalline polyester to lower a glass transition temperature (Tg) of the resin.

Further, Japanese published unexamined application No. 2008-242473 discloses a method of making the shape of toner particles and the content rate of a fine powder have a specific relation so that the resultant toner has good low-temperature fixability and heat-resistant storage stability. However, when the Tg is too low, the heat-resistant storage stability deteriorates. When flow tester ½ temperature (T1/2) is too low, the temperature at which hot offset occurs is lowered.

Some image forming methods specifying the Tg or flow tester ½ temperature (T1/2) disclose that the resultant toner has both good low-temperature fixability and heat-resistant storage stability. However, although generally successful, even Japanese Patent No. 4,347,174, and Japanese published unexamined applications Nos. 2007-233169 and 2008-242473 do not suffice for a toner to have both low-temperature fixability and heat-resistant storage stability, and need further improvement in terms of saving energy.

For these reasons, a need exists for a toner capable of forming high-quality images, having good low-temperature fixability and heat-resistant storage stability.

SUMMARY OF THE INVENTION

Accordingly, an object of the present invention is to provide a toner capable of forming high-quality images, having good low-temperature fixability and heat-resistant storage stability.

Another object of the present invention is to provide a developer including the toner.

A further object of the present invention is to provide an image forming apparatus using the toner.

Another object of the present invention is to provide an image forming method using the toner.

These objects and other objects of the present invention, either individually or collectively, have been satisfied by the discovery of a toner for developing electrostatic latent images, comprising:

a binder resin;

a colorant; and a release agent, wherein the toner has a glass transition temperature (Tg) of from 55 to 75° C., a melting point (T1/2) of from 95 to 125° C. measured by a flow tester in a ½ method and ΔTs of from 1 to 5° C., and wherein ΔTs is defined by the following formula:

$$\Delta Ts = Ts - T(Ls/2)$$

wherein Ts is a softening point of the toner; T(Ls/2) is a temperature when a stroke is Ls/2; and Ls is a stroke (mm) at Ts.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a toner capable of forming high-quality images, having good low-temperature fixability and heat-resistant storage stability.

Hereinafter, the toner of the present invention will be explained in detail.

A toner preferably has a glass transition temperature (Tg) of from 55 to 75° C. so as to have heat-resistant storage stability without blocking while stored and at an atmospheric temperature in an apparatus. When less than 55° C., toners adhere to each other and agglutinate due to an external environmental temperature and an excessive pressure. When higher than 75° C., the toner deteriorates in low-temperature fixability.

Therefore, the toner of the present invention preferably has a glass transition temperature (Tg) of from 55 to 75° C., and more preferably from 55 to 65° C.

Tg is measured by DSC-60 from Shimadzu Corp.

First, about 5.0 mg of a sample is placed in a sample container made of aluminum, the sample container is placed on a holder unit and the holder unit is set in an electric oven. Next, after the holder unit is heated from room temperature to 150° C. at a temperature increase rate of 10° C./min (first heating process), the holder unit is cooled from 150 to room temperature at a temperature decrease rate of 10° C./min. Further, the holder unit is heated again to 150° C. at a temperature increase rate of 10° C./min (second heating process) under a nitrogen atmosphere to perform DSC measurement. Tg is determined from a contact point between a tangent line of an endothermic curve close to Tg and a base line using an analysis program in the DSC-60 system. In the present invention, Tg in the first heating process is used.

ΔTs (° C.) is a difference between a softening point Ts of a toner, measured by a flow tester, and a temperature T (Ls/2) at a half of stroke (mm) at Ts.

Figure 1:
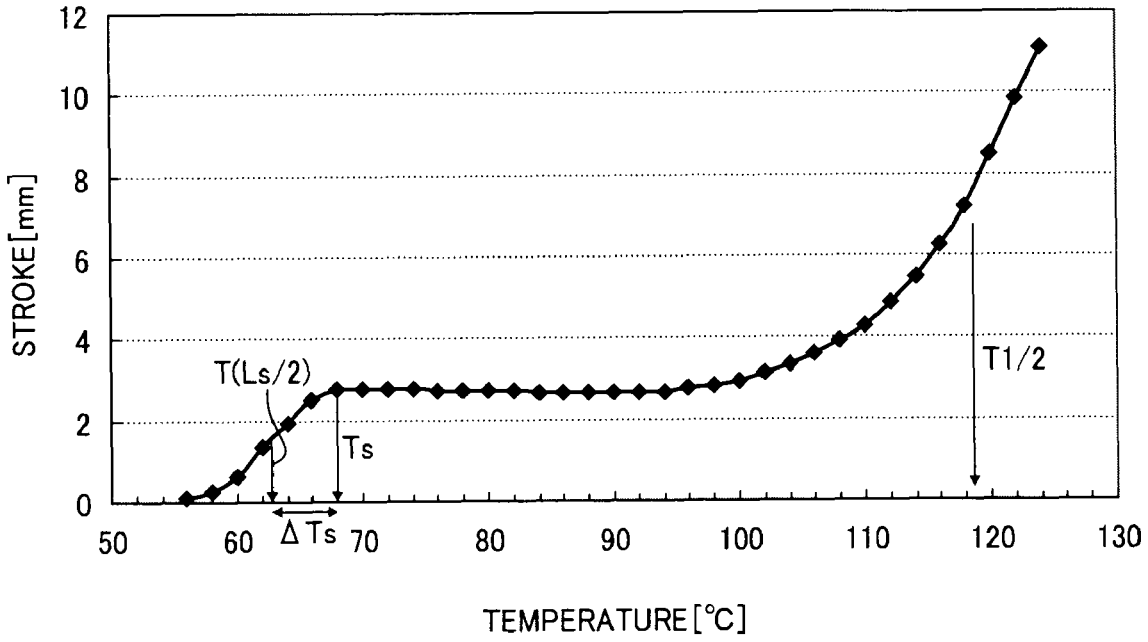
FIG. 1 is a diagram showing an example of flow curve which is a result of measuring a toner with an elevated flow tester.

FIG. 1 is a diagram showing an example of flow curve which is a result of measuring a toner with an elevated flow tester. ΔTs shows likeliness for a toner to soften until a softening point. The smaller ΔTs, the sharper the meltability of the toner. When ΔTs is less than 1° C., the toner is difficult to produce. When greater than 5° C., the toner has broad meltability and is difficult to have low-temperature fixability. ΔTs is preferably from 2 to 5° C. for a toner to produce high-quality images, and preferably from 1 to 3° C. therefore to have low-temperature fixability and heat-resistant storage stability.

The flow tester includes, e.g., elevated flow tester CFT-100D from Shimadzu Corp. The flow curve in FIG. 1 is obtained by the flow tester. In FIG. 1, Ts is a softening point and T1/2 is a melting point in ½ method. The measurement conditions with the flow tester are as follows:

load: 10 kgs;

heating speed: 3° C./min;

die caliber: 1.0 mm; and die length: 10 mm.

The toner of the present invention has a melting point of T1/2 from 95 to 125° C. when measured by flow tester in ½ method. This is essential as well as the above-mentioned Tg and ΔTs so that the toner has both heat-resistant storage stability and low-temperature fixability.

Even when Tg and ΔTs satisfy the above-mentioned conditions, the toner does not have good low-temperature fixability when T1/2 is higher than 125° C. Even when Tg and ΔTs satisfy the above-mentioned conditions, the toner deteriorates in heat-resistant storage stability when T1/2 is less than 95° C.

The melting point T1/2 is measured by the above-mentioned measurement method with the flow tester.

In order to prepare a toner satisfying such Tg, ΔTs and T1/2, a shell layer formed of an organic particulate material, etc. mentioned later is effectively formed around the toner. The thickness of the shell layer is controlled by the particle diameter of the organic particulate material, and further the monomer configuration and the content of the crystalline polyester are controlled to obtain desired Tg, ΔTs and T1/2. The thick shell layer can maintain high Tg even when the core binder resin has a low softening point. The organic particulate material preferably has a diameter of from 100 to 500 nm. More similar compounds forming the monomer configuration of the crystalline polyester increase compatibility, and the resultant toner has sharper softening property. Besides these, the combination balance with highly-crosslinked resin mentioned later, low-molecular-weight resin and crystalline polyester makes T1/2 satisfy the requirements of the present invention. Conventional toners have large ΔTs and difficult to have sharp softening properties. In addition, even having sharp ΔTs, conventional toners have high T1/2 which is disadvantageous to low-temperature fixability, and low Tg which deteriorates heat-resistant storage stability. Even crystalline polyester which is used in a toner being prepared by melting and kneading methods is compatible with an amorphous resin when heated, and the toner doe not have heat-resistant storage stability. Solution suspension methods of incompatibly dispersing the crystalline polyester with another resin can prepare a toner having heat-resistant storage stability just before heated and low-temperature fixability when heated because the crystalline polyester becomes compatible with an amorphous resin and quickly softens.

Further, the toner preferably has a melting point Ts not less than 67° C. to have good heat-resistant storage stability. When less than 67° C., the toner deteriorates in heat-resistant storage stability.

In addition, the toner preferably has a melting point Ts not greater than 80° C. When higher than 80° C., the toner deteriorates in low-temperature fixability.

The toner preferably has a volume-average particle diameter (D4) of from 2 to 7 μm and a ratio (D4/Dn) of the volume-average particle diameter (D4) to a number-average particle diameter (Dn) not greater than 1.25 to have a sharp particle diameter distribution and produce high-quality images.

The volume-average particle diameter (D4), the number-average diameter (Dn) and the ratio (D4/Dn) are measured by Coulter Multisizer III from Coulter Electronics, Inc. under the following method:

0.1 to 5 ml of a surfactant, preferably polyoxyethylene-alkylether (a nonionic surfactant), is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid;

a volume and a number of the toner particles are measured by the above-mentioned measurer using an aperture of 100 μm to determine a volume distribution and a number distribution; and the volume-average particle diameter (D4) and the number-average diameter (Dn) are determined from the distributions.

256 channels are used and particles having a diameter not less than 2 μm or less than 60 μm are measured.

The toner preferably has a shape factor SF-1 of from 100 to 150 and a shape factor SF-2 of from 100 to 140 to improve in heat conductivity and have low-temperature fixability in short time.

200 SEM images of the toner observed by a scanning electron microscope are randomly sampled, and the image information is analyzed with an image analysis software (Laser Microscope Solution Software Lm eye) from Lasertec Corp., and SF-1 and SF-2 are determined by the following formulae:

$$SF\text{-}1=(L2/A)\times(\Pi/4)\times100$$

$$SF\text{-}2=(P2/A)\times(1/4\Pi)\times100$$

wherein L is a maximum length of the toner, A is a projected area and a maximum circumferential length of the toner.

Both of SF-1 and SF-2 are 100 when a toner has true spherical form. The larger than 100, the more infinite. Particularly, SF-1 represents the whole shape of a toner such as an ellipse or a sphere, and SF-2 represents concavities and convexities of the surface of a toner.

SF-1 and SF-2 are preferably determined thereby, but which is not limited to the SEM and the software is not limited to the above as long as a similar analytical result can be obtained.

The toner of the present invention includes a binder resin and a colorant.

The binder resin preferably includes a polyester resin, and more preferably a crystalline polyester resin. The polyester resin expands designs of molecular weight and thermal properties of the resin. The crystalline polyester resin increases Tg, decreases ΔTS to sharpen softening property, and T1/2. A combination of the crystalline polyester resin and an amorphous resin sharpens softening property more than the amorphous resin alone, and the resultant toner has both heat-resistant storage stability and low-temperature fixability.

In the present invention, an amorphous modified polyester resin (A), an amorphous unmodified polyester resin (C) or a crystalline polyester can be used as a binder resin. These can be used alone or in combination. Obviously, the present invention is not limited to these resins and conventional known resins can be used.

The toner of the present invention may include a crosslinker, an elongator, a release agent, a charge controlling agent, an external additive or a particulate resin when necessary.

The constituent materials of the toner of the present invention will be explained in detail with specific examples.

In the present invention, modified polyester resins such as a polyester prepolymer having an isocyanate group can be used as the amorphous polyester resins. The polyester prepolymer (A) having an isocyanate group is formed by polycondensating polyol (1) and a polycarboxylic acid (2) to form polyester having an active hydrogen group, and further reacting the polyester having an active hydrogen with polyisocyanate (3). Specific examples of the active hydrogen group include hydroxyl groups such as alcoholic hydroxyl groups and phenolic hydroxyl groups, amino groups, carboxyl groups, mercapto groups, etc. Among these, alcoholic hydroxyl groups are preferably used.

As the polyol (1), diol (1-1) and tri- or more valent polyols (1-2) can be used, and (1-1) alone or a mixture of (1-1) and a small amount of (1-2) are preferably used.

Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used. Specific examples of the tri- or more polyols (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned tri- or more valent polyphenol with an alkylene oxide.

As the polycarboxylic acid (2), dicarboxylic acids (2-1) and tri- or more valent polycarboxylic acids (2-2) can be used. (2-1) alone, or a mixture of (2-1) and a small amount of (2-2) are preferably used. Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used. Specific examples of the tri- or more valent polycarboxylic acid (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

The polyol (1) and polycarboxylic acid (2) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenedisocyanate and diphenylmethanediisocyanate; aromatic aliphatic diisocyanates such as α,α,α',α'-tetramethylxylylenediisocyanate; isocyanurates; the above-mentioned polyisocyanates blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates. A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, the hot offset resistance of the resultant toner deteriorates, and in addition, the heat resistance and low-temperature fixability of the toner also deteriorate. In contrast, when the content is greater than 40% by weight, the low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the modified polyester decreases In the present invention, it is essential that an amorphous unmodified polyester resin (C) is used in combination with the modified polyester resin (A) as a toner binder resin, which improves low-temperature fixability of the resultant toner and a glossiness of full color images produced thereby. Specific examples of the unmodified polyester resin (C) include polycondensated products between the polyol (1) and polycarboxylic acid (2) similarly to the modified polyester resin (A), and products preferably used are the same as those thereof. The unmodified polyester (C) can be substituted with another modified polyester other than a urea-modified polyester such as a urethane-modified polyester.

It is preferable that the modified polyester resin (A) and unmodified polyester resin (C) are at least partially soluble each other in terms of the low-temperature fixability and hot offset resistance of the resultant toner. Therefore, the modified polyester resin (A) and unmodified polyester resin (C) preferably have similar compositions. When the unmodified polyester resin (C) is used in combination, a weight ratio ((A)/(C)) between the modified polyester resin (A) and unmodified polyester resin (C) is from 5/95 to 75/25, preferably from 10/90 to 25/75, more preferably from 12/88 to 25/75, and most preferably from 12/88 to 22/78. When the modified polyester resin (A) has a weight ratio less than 5%, the resultant toner has a poor hot offset resistance, and has a difficulty in having heat-resistant storage stability and low-temperature fixability.

The unmodified polyester resin (C) preferably has a peak molecular weight of from 1,000 to 30,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (C) preferably has a hydroxyl value not less than 5 mg KOH/g, more preferably of from 10 to 120 mg KOH/g, and most preferably from 20 to 80 mg KOH/g. When less than 5, the resultant toner has a difficulty in having heat-resistant storage stability and low-temperature fixability. The unmodified polyester resin (C) preferably has an acid value of from 0.5 to 40 mg KOH/g, and more preferably from 5 to 35 mg KOH/g such that the resultant toner tends to be negatively charged and to have better fixability. When the acid value and hydroxyl value are greater than the maximum value, the resultant toner tends to be affected by an environment such as an environment of high (low) temperature and high (low) humidity, and produces poor quality images.

Polymers include polyethylene resins, polybutadiene resins, polyester resins, etc., and the polyester resins are preferably used in terms of crystallinity and softening point. Particularly, a crystalline polyester resin is preferably formed from an alcohol including diol compounds having 2 to 6 carbon atoms such as 1,4-butandiol and 1,6-hexanediol and their derivatives, and an acid such as a maleic acid, a fumaric acid and a succinic acid and their derivatives. Methods of controlling crystallinity and softening point of the crystalline polyester resin include a method of designing and using non-linear polyester formed by a condensation polymerization in which tri- or more valent polyalcohol such as glycerin is added to the alcohol or tri- or more valent polycarboxylic acid such as trimellitic anhydride is added to the acid when the polyester is formed.

In the present invention, the presence of crystallinity of the crystalline polymer can be confirmed by diffraction peaks in an X-ray diffraction spectrum of CuKα, which at least appear at points where Bragg angle) (2θ±0.2°) is from 19 to 20°, 21 to 22°, 23 to 25° and 29 to 31°.

The toner preferably includes the crystalline polyester in an amount of from 25 to 80% by weight. When less than 25% by weight, the resultant toner does not have sufficient low-temperature fixability. When greater than 80% by weight, the charge quantity decreases.

In the present invention, amines can be used as a crosslinker and/or an elongator. Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophoronediamine; aliphatic diamines such as ethylene diamine, tetramethylene diamine and hexamethylene diamine, etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine (B1) is mixed with a small amount of a polyamine (B2) are preferably used.

The molecular weight of the modified polyesters can be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, the molecular weight of the urea-modified polyester (i) decreases, resulting in deterioration of hot offset resistance of the resultant toner.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussianblue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner preferably includes the colorant in an amount of from 1 to 15% by weight, and more preferably from 3 to 10% by weight.

The colorant for use in the present invention can be used as a masterbatch when combined with a resin.

Specific examples of the resin include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The masterbatch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three-roll mill is preferably used for kneading the mixture upon application of high shear stress.

The release agent is not particularly limited, and can be properly selected from known release agents, e.g., waxes are preferably used as the release agent. Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used.

Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used. The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. The wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. The toner preferably includes a wax in an amount of from 1 to 40% by weight, and more preferably from 3 to 30% by weight. When greater than 40% by weight, the resultant toner possibly deteriorates in fluidity.

The toner of the present invention may include a charge controlling agent when necessary. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images. The charge controlling agent may be melted and kneaded with the masterbatch, and dissolved or dispersed, dissolved or dispersed in an organic solvent with other toner materials, or fixed on the surface of a toner after prepared.

As an external additive to subsidize the fluidity, developability and chargeability of a colored particle prepared in the present invention, besides an oxidized particulate material, inorganic particulate material and hydrophobized inorganic particulate material can be used together. It is preferable that the colored particle externally includes at least one hydrophobized inorganic particulate material having an average primary particle diameter of from 1 to 100 nm, and more preferably from 5 to 70 nm. Further, it is more preferable that at least one hydrophobized inorganic particulate material having an average primary particle diameter not greater than 20 nm and an inorganic particulate material having an average primary particle diameter not less than 30 nm. The external additive preferably has a specific surface area of from 20 to 500 $m^2/g$ when measured by a BET method.

Any known inorganic particulate materials and hydrophobized inorganic particulate materials can be used as the external additives. Specific examples of the external additives include particulate silica, hydrophobized silica, fatty acid metallic salts such as zinc stearate and aluminium stearate, metal oxides such as titania, alumina, tin oxide and antimony oxide, fluoropolymers, etc.

Particularly, the particulate hydrophobized silica, titania and alumina are preferably used. Specific examples of the particulate silica include HDK H 2000, HDK H 2000/4, HDK H 2050EP and HVK21 from Hoechst AG; and R972, R974, RX200, RY200, R202, R805 and R812 from Nippon Aerosil Co. Specific examples of the particulate titania include P-25 from Nippon Aerosil Co.; ST-30 and STT-65C-S from Titan Kogyo K.K.; TAF-140 from Fuji Titanium Industry Co., Ltd.; MT150W, MT-500B and MT-600b from Tayca Corp., etc. Specific examples of the particulate hydrophobized titanium oxide include T-805 from Nippon Aerosil Co.; STT-30A and STT-65S-S from Titan Kogyo K. K.; TAF-500T and TAF-1500T from Fuji Titanium Industry Co., Ltd.; MT-100S and MT100T from Tayca Corp.; IT-S from Ishihara Sangyo Kaisha Ltd., etc.

To prepare the particulate hydrophobized silica, titania or alumina, a hydrophilic particulate material is subjected to silane coupling agents such as methyltrimethoxy silane, methyltriethoxy silane and octylmethoxy silane. An inorganic particulate material optionally subjected to a silicone oil upon application of heat is preferably used.

The toner of the present invention may optionally include a particulate resin. The particulate resin preferably has a glass transition temperature (Tg) of from 40 to 100° C. and a weight-average molecular weight of from 9,000 to 200,000. When the glass transition temperature (Tg) is less than 40° C. and/or weight-average molecular weight is less than 9,000, storage stability of the resultant toner deteriorates, and blocking thereof occurs when stored and in an image developer. When the glass transition temperature (Tg) is greater than 100° C. and/or weight-average molecular weight is greater than 200,000, the particulate resin impairs adherence of the resultant toner to a transfer paper and increase the fixable minimum temperature thereof.

The particulate resin preferably has a residual ratio of from 0.5 to 5.0% by weight based on total weight of the toner. When less than 0.5% by weight, storage stability of the resultant toner deteriorates, and blocking thereof occurs when stored and in an image developer. When greater than 5.0% by weight, the particulate resin prevents a wax from seeping to impair releasability of the resultant toner, resulting in occurrence of offset.

The residual ratio of the particulate resin can be determined from a peak area measured by analyzing a material with a pyrolysis gas chromatographic mass analyzer. The mass analyzer is preferably used, but not limited thereto.

Any thermoplastic and thermosetting resins capable of forming an aqueous dispersion can be used as the particulate resin. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination. Among these resins, the vinyl resins, polyurethane resins, epoxy resin, polyester resins or their combinations are preferably used because an aqueous dispersion of a fine-spherical particulate resin can easily be obtained.

Specific examples of the vinyl resins include single-polymerized or copolymerized vinyl monomers such as a styrene-ester(metha)acrylate resin, a styrene-butadiene copolymers, a (metha)acrylic acid-esteracrylate polymer, a styrene-acrylonitrile copolymer, a styrene-maleic acid anhydride copolymer and a styrene-(metha) acrylic acid copolymer.

The toner of the present invention can be prepared by the following method, but the method is not limited thereto.

The toner binder of the present invention can be prepared, for example, by the following method. Polyol (1) and polycarboxylic acid (2) are heated at a temperature of from 150 to 280° C. in the presence of a known catalyst such as tetrabutoxy titanate and dibutyltinoxide. Then water generated is removed, under a reduced pressure if desired, to prepare a polyester resin having a hydroxyl group. Then the polyester resin is reacted with polyisocyanate (3) at a temperature of from 40 to 140° C. to prepare a prepolymer (A) having an isocyanate group.

A particulate resin is previously added to an aqueous phase. The aqueous phase may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner is prepared by reacting a dispersion including the prepolymer having an isocyanate group (A) dissolved or dispersed in an organic solvent with the amines (B) in an aqueous medium. As a method of stably preparing the dispersion formed of the prepolymer (A) in an aqueous medium, a method of including a toner constituent formed of the prepolymer (A) into an aqueous medium and dispersing them upon application of shear stress is preferably used. The prepolymer (A) and other toner constituents (hereinafter referred to as toner materials) such as colorants, master batch pigments, release agents and charge controlling agents, etc. may be added into an aqueous medium at the same time when the dispersion is prepared. However, it is preferable that the toner materials are previously mixed, and then are added to the aqueous medium. In addition, other toner materials such as colorants, release agents, charge controlling agents, etc., are not necessarily added to the aqueous dispersion before particles are formed, and may be added thereto after particles are prepared in the aqueous medium. For example, after forming particles without a colorant, a colorant can also be added thereto by known dying methods.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 min. The temperature in the dispersion process is typically from 0 to 150° C. (under pressure), and preferably from 40 to 98° C. When the temperature is relatively high, the prepolymer (A) can easily be dispersed because the dispersion formed thereof has a low viscosity.

A content of the aqueous medium to 100 parts by weight of the toner constituent including the prepolymer (A) is typically from 50 to 2,000 parts by weight, and preferably from 100 to 1,000 parts by weight. When the content is less than 50 parts by weight, the dispersion of the toner constituent in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

Specific preferred examples of the dispersants used to emulsify and disperse an oil phase in an aqueous liquid in which the toner constituent is dispersed, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including a toner constituent in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite, which are hardly soluble in water, can also be used.

Further, it is possible to stably disperse a toner constituent in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having ahydroxyl group (e.g., β-hydroxyethylacrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the elongation and/or crosslinking reaction of the prepolymer with amine in terms of chargeability of the resultant toner.

The elongation and/or crosslinking reaction time depend on reactivity of the isocyanate structure of the prepolymer (A)

and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

In addition, a method of blowing air with a rotary evaporator to remove the organic solvent can also be used.

Then, the emulsified dispersion is roughly separated with a centrifugal separator, and repeatedly washed in a washing tank and dried with a hot air drier to prepare a mother toner. Then, an aging process is preferably included to control a hollow status in the toner. The aging process is preferably performed at 30 to 55° C., and more preferably at 40 to 50° C. for 5 to 36 hrs, and more preferably for 10 to 24 hrs.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. A powder after the dispersion liquid is dried can be classified, but the liquid is preferably classified in terms of efficiency. Unnecessary fine and coarse particles can be recycled to a kneading process to form particles. The fine and coarse particles may be wet when recycled.

A dispersant is preferably removed from a dispersion liquid, and more preferably removed at the same time when the above-mentioned classification is performed.

Heterogeneous particles such as release agent particles, charge controlling particles, fluidizing particles and colorant particles can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Finally, an external additive such as an inorganic particulate material and the mother toner are mixed by a HENSCHEL mixer and coarse toner particles are removed by an ultrasonic sifter to prepare a final toner.

The toner of the present invention can be used for a two-component developer in which the toner is mixed with a magnetic carrier. The content of the toner is preferably from 1 to 10 parts by weight per 100 parts by weight of the carrier.

Suitable carriers for use in the two component developer include known carrier materials such as iron powders, ferrite powders, magnetite powders, magnetic resin carriers, which have a particle diameter of from about 20 to 200 μm. The carrier may be coated by a resin. Specific examples of such resins to be coated on the carriers include amino resins such as a urea-formaldehyde resin, a melamine resin, a benzoguanamine resin, a urea resins, and a polyamide resin, and an epoxy resin. In addition, vinyl or vinylidene resins such as an acrylic resin, a polymethylmethacrylate resin, a polyacrylonitirile resin, a polyvinyl acetate resin, a polyvinyl alcohol resin, a polyvinyl butyral resin, a polystyrene resin, a styrene-acrylic copolymer; halogenated olefin resins such as a polyvinyl chloride resin; polyester resins such as a polyethyleneterephthalate resin and a polybutyleneterephthalate resin; polycarbonate resins; polyethylene resins; polyvinyl fluoride resins; polyvinylidene fluoride resins; polytrifluoroethylene resins; polyhexafluoropropylene resins; vinylidenefluoride-acrylate copolymers; vinylidenefluoride-vinylfluoride copolymers; copolymers of tetrafluoroethylene; vinylidenefluoride and other monomers including no fluorine atom; and silicone resins, etc. can be used.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

Figure 2:
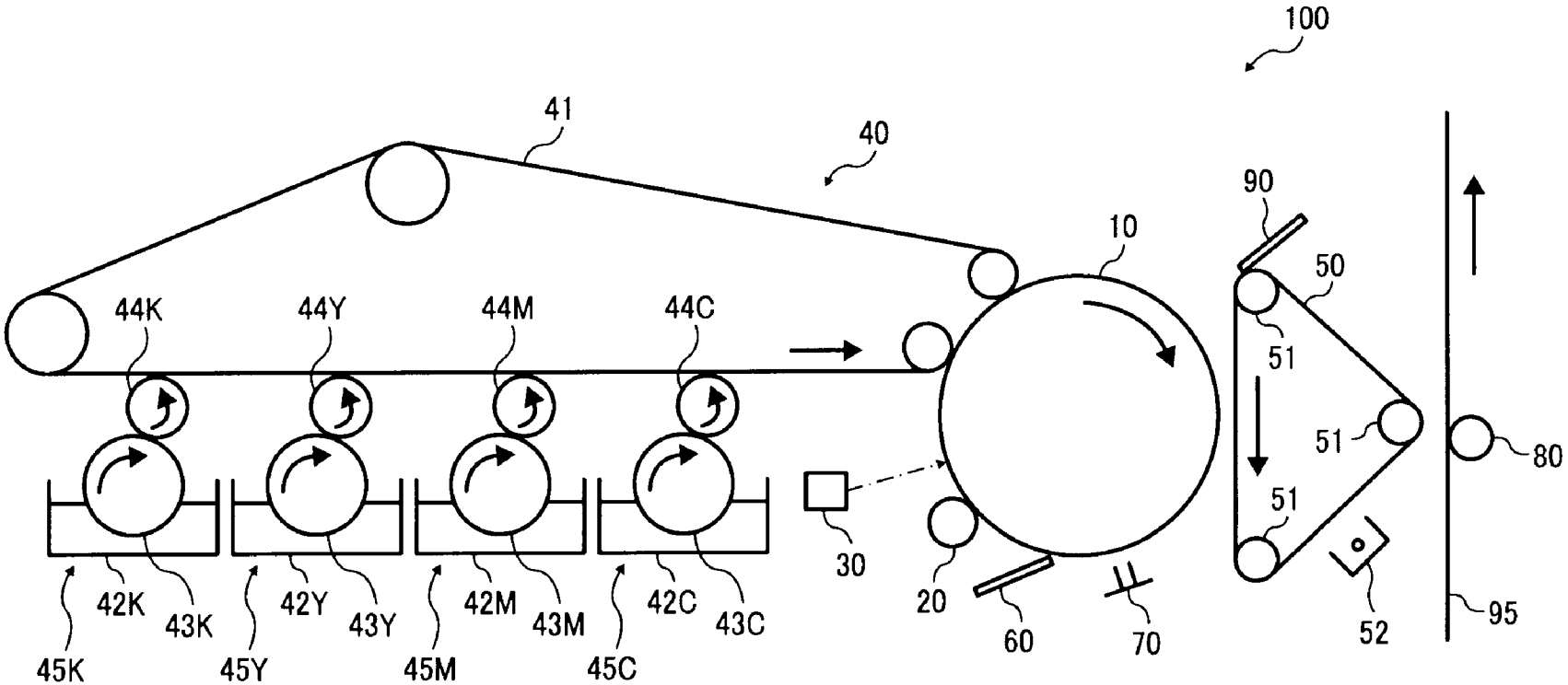
FIG. 2 is a schematic cross-sectional view illustrating an embodiment of the image forming apparatus of the present invention.

A first embodiment of the image forming method of the present invention will be explained, referring to FIG. 2. An image forming apparatus 100 in FIG. 2 includes a photoreceptor drum 10 (hereinafter referred to as a photoreceptor 10) as an electrostatic latent image bearer, a charging roller as a charger 20, an irradiator 30, an image developer 40, an intermediate transferer 50, a cleaner 60 having a cleaning blade and a discharge lamp 70 as a discharger.

The intermediate transferer 50 is an endless belt suspended and extended by here rollers 51, and is transportable in the direction indicated by an arrow. The three rollers 51 partly work as a transfer bias roller capable of applying a predetermined first transfer bias to the intermediate transferer 50. A cleaner 90 having a cleaning blade is located close thereto and a transfer roller 80 capable of applying a transfer bias to a transfer paper 95 as a final transfer material to transfer (second transfer) the toner image thereon is located at the other side of the transfer paper 9. Around the intermediate transferer 50, a corona charger 58 charging the toner image thereon is located between a contact point of the photoreceptor 10 and the intermediate transferer 50 and a contact point of the intermediate transferer 50 and a transfer paper 95 in the rotating direction of the intermediate transferer 50.

The image developer 40 includes a developing belt 41 as a developer bearer, a black developing unit 45K, a yellow developing unit 45Y, a magenta developing unit 45M and a cyan developing unit 45C around the developing belt 41. The black developing unit 45K includes a developer container 42K, a developer feed roller 43K and a developing roller 44K; the yellow developing unit 45Y includes a developer container 42Y, a developer feed roller 43Y and a developing roller 44Y; the magenta developing unit 45M includes a developer container 42M, a developer feed roller 43M and a developing roller 44M; and the cyan developing unit 45C includes a developer container 42C, a developer feed roller 43C and a developing roller 44C. The developing belt 41 is an endless belt rotatably suspended and extended by plural rollers, and partly contacts the photoreceptor 10.

The charging roller 20 uniformly charges the photoreceptor 10. The irradiator 30 irradiates imagewise light to the photoreceptor 10 to form an electrostatic latent image thereon. The electrostatic latent image formed thereon is developed with a toner fed from the image developer 40 to form a visible image (toner image) thereon. The visible image (toner image) is transferred (first transfer) onto the intermediate transferer 50 with a voltage applied from the roller 51, and is further transferred (second transfer) onto a transfer paper 95. The toner remaining on the photoreceptor 10 is removed by a cleaner 60, and the photoreceptor 10 is discharged by the discharge lamp 70.

Figure 3:
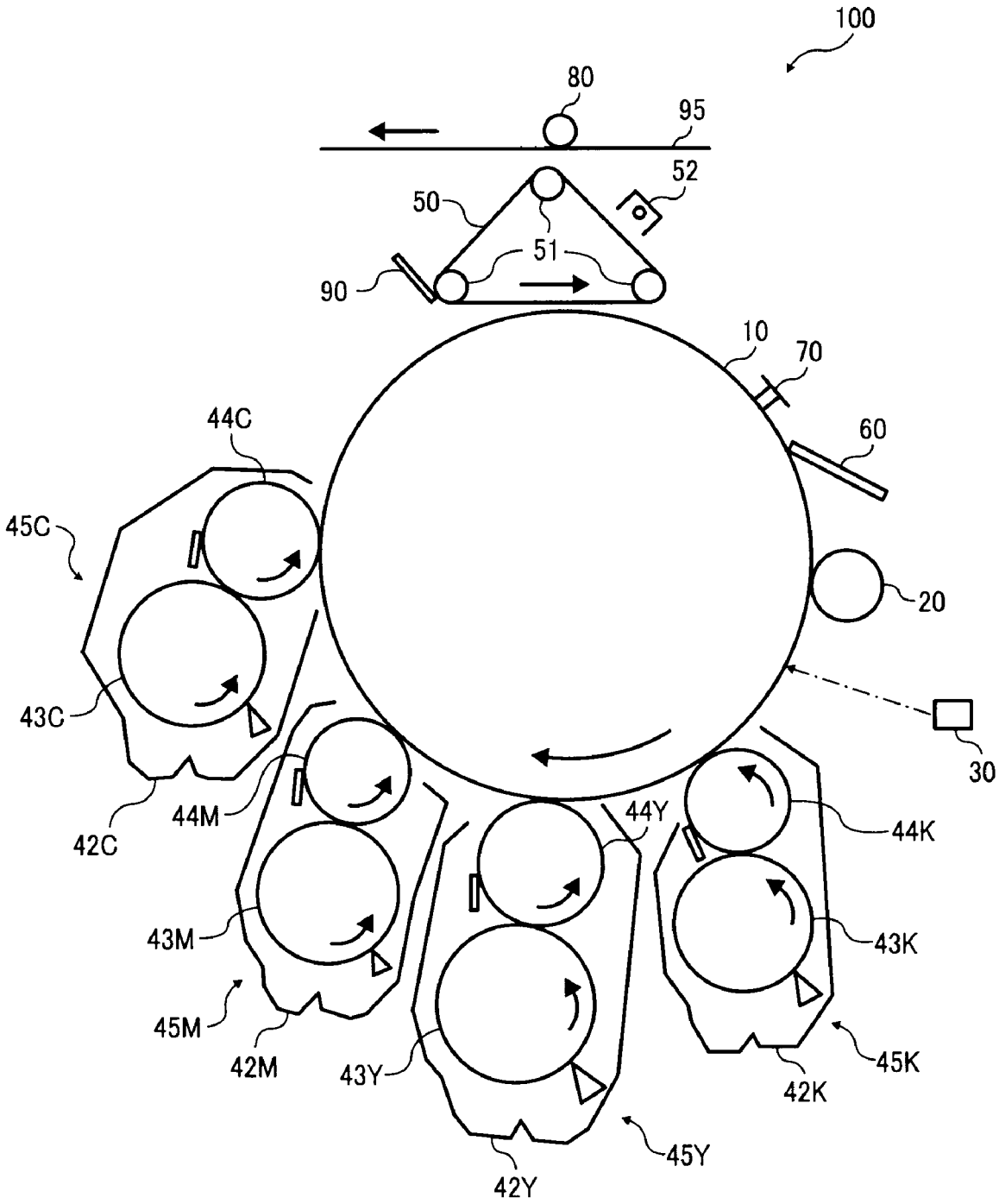
FIG. 3 is a schematic cross-sectional view illustrating another embodiment of the image forming apparatus of the present invention.

A second embodiment of the image forming method of the present invention will be explained, referring to FIG. 3. An image forming apparatus 100 in FIG. 3 has the same constitutions as that of FIG. 2 except that the developing belt 41 is not located and the black developing unit 45K, yellow developing unit 45Y, magenta developing unit 45M and cyan developing unit 45C are located around the photoreceptor 10, facing thereto. The same elements therein have the same numbers as those in FIG. 2.

Figure 4:
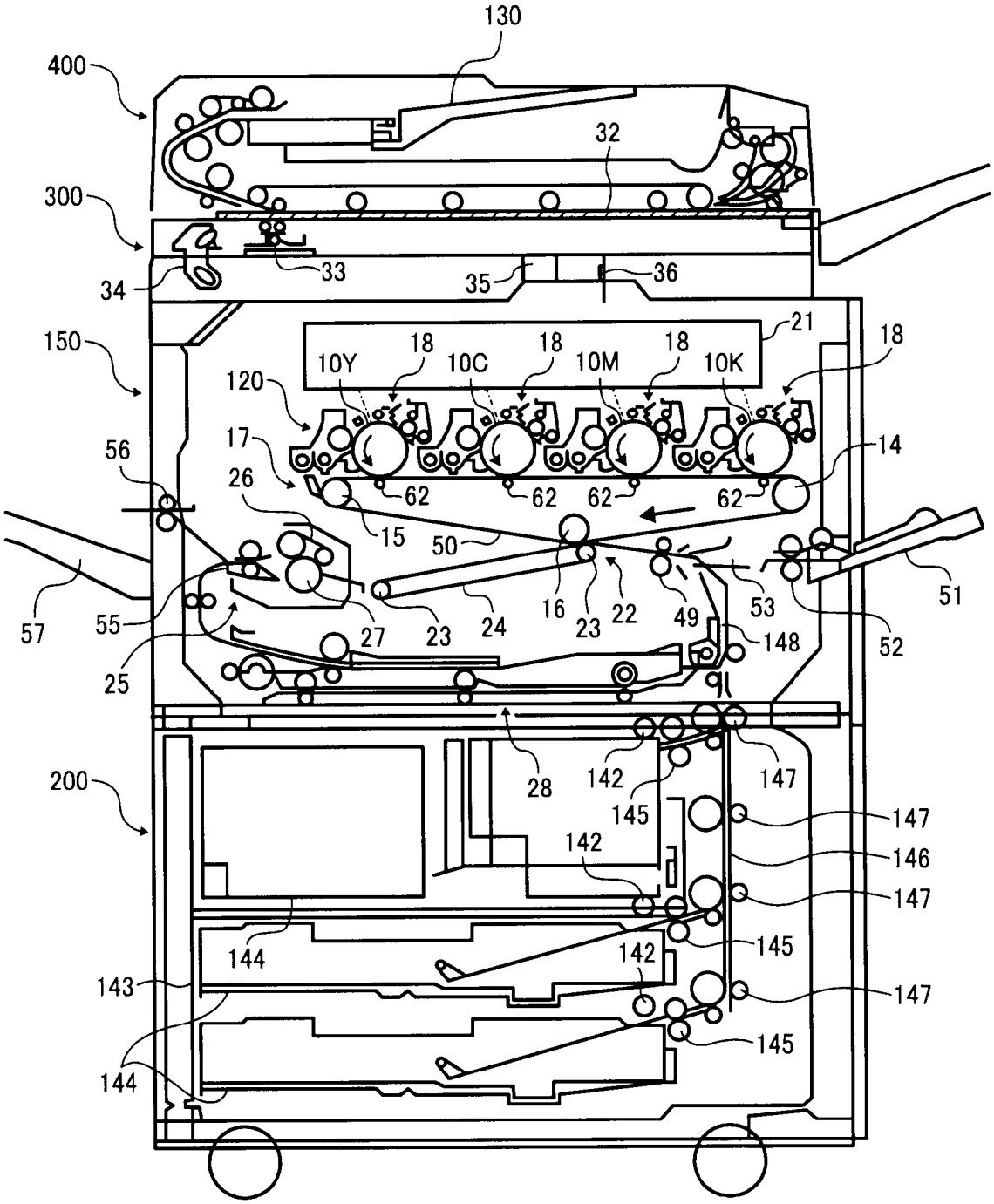
FIG. 4 is a schematic cross-sectional view illustrating a further embodiment of the image forming apparatus of the present invention.

A third embodiment of the image forming method of the present invention will be explained, referring to FIG. 4. An image forming apparatus 100 in FIG. 4 is a tandem full-color image forming apparatus. The image forming apparatus includes a duplicator 150, a paper feeding table 200, a scanner 300 and an automatic document feeder (ADF) 400.

The duplicator 150 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form a tandem image forming developer 120. Above the tandem color image developer 120, an irradiator 21 is located. On the opposite side of the tandem color image developer 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes an endless fixing belt 26 and a pressure roller 27 pressing the fixing belt 26.

Below the second transferer 22 and the fixer 25, a sheet reverser 28 reversing the sheet to form an image on both sides thereof is located in the tandem color image forming apparatus.

Full-color image formation using a tandem image developer 120 will be explained. An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 130 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Figure 5:
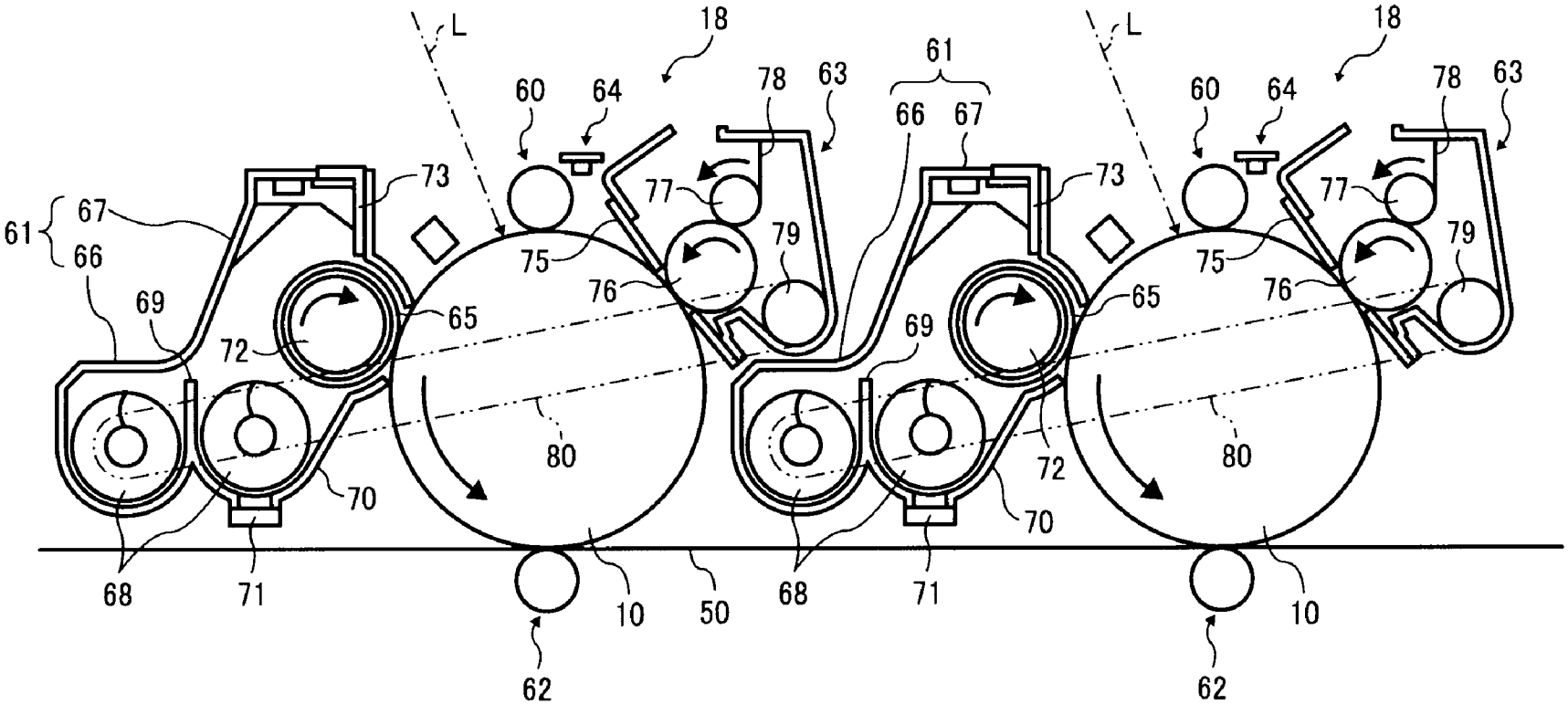
FIG. 5 is an amplified cross-sectional schematic view illustrating an image forming unit of the embodiment of the image forming apparatus in FIG. 4.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 5, a photoreceptor 10, i.e., a photoreceptor for black 10K, a photoreceptor for yellow 10Y, a photoreceptor for magenta 10M and a photoreceptor for cyan 10C; a charger 59 uniformly charging the photoreceptor; an irradiator irradiating the photoreceptor with imagewise light (L in FIG. 5) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto an intermediate transferer 50; a photoreceptor cleaner 63; and a discharger 64. A black image (K), a yellow image (Y), a magenta image (M) and cyan image (C) formed on respective photoreceptors 10K, 10Y, 10M and 10C re sequentially transferred (first transfer) onto the intermediate transferer 50 rotated by the suspension rollers 14, 15 and 16 to form a full-color image thereon.

On the other hand, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a registration roller 49. Alternatively, a paper feeding roller 150 is rotated to take a sheet out of a manual feeding tray 51, and a separation roller 52 separates sheets one by one and feed the sheet into a paper feeding route 53 to be stopped against the registration roller 49. The registration roller 49 is typically earthed, and may be biased to remove a paper dust from the sheet.

Then, in timing with a synthesized full-color image on the intermediate transferer 50, the registration roller 49 is rotated to feed the sheet between the intermediate transferer 50 and the second transferer 22, and the second transferer transfers (second transfer) the full-color image onto the sheet. The intermediate transferer 50 after transferring an image is cleaned by the intermediate transferer cleaner 17 to remove a residual toner thereon after the image is transferred.

The sheet the full-color image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

Figure 6:
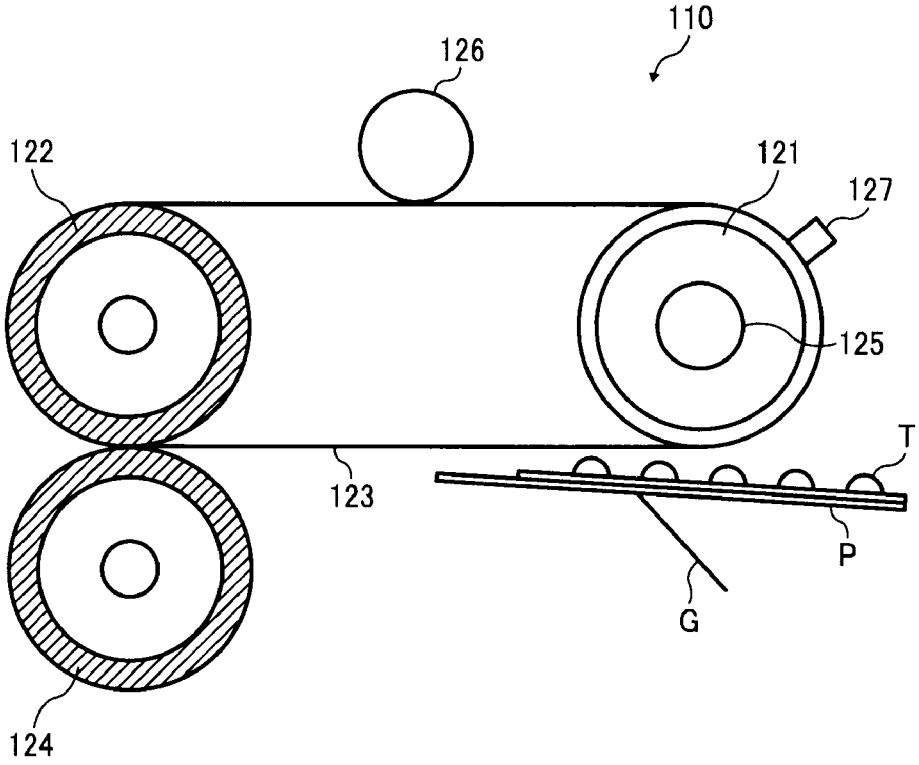
FIG. 6 is a schematic cross-sectional view illustrating a configuration of a belt-type fixer.

FIG. 6 is a schematic cross-sectional view illustrating a configuration of a belt-type fixer.

In the present invention, any fixing methods can be used as long as a toner image can be fixed on a transfer material. However, belt fixing methods are preferably used therein.

Particularly, the fixer includes a heating element, a heat-transfer medium heated thereby and a pressure member contacting the transfer material to the heat-transfer medium upon application of pressure. The heat-transfer medium is preferably a belt-shaped heat-transfer medium.

As shown in FIG. 6, the fixer 110 includes a heat source 125, a rotatable heat roller 121 as a heating element, a fixing roller 122, and a fixing belt 123 suspended thereby. In addition, the fixing roller 122 and a pressure roller 124 are located facing each other, sandwiching the fixing belt 123. A temperature sensor 127 detects a temperature of the heat roller 121 to control the temperature with a controller (not shown).

A nip surface is formed between the pressure roller 124 and the fixing roller 122, and a transfer paper P holding a toner image (Toner T) is fed thereto. The fixing belt 123, the pressure roller 124 and the heat roller 121 rotate being driven by the fixing roller 122 rotated by a driver (not shown) to fix the toner image on a recording material with a heat from the fixing belt 123 and a surface pressure at the nip surface. The pressure roller 124 preferably has a surface pressure of from 10 to 80 N/cm$^2$ to uniformly fix the toner image on the transfer paper.

The transfer paper is discharged from image forming apparatus after passing the nip surface. The fixing belt 123 is cleaned by a cleaning roller 126 to remove offset images and waxes, and ready for a following fixing process.

An oil may be applied to the fixing belt 123 by an oil applicator (not shown) when necessary.

Figure 7:
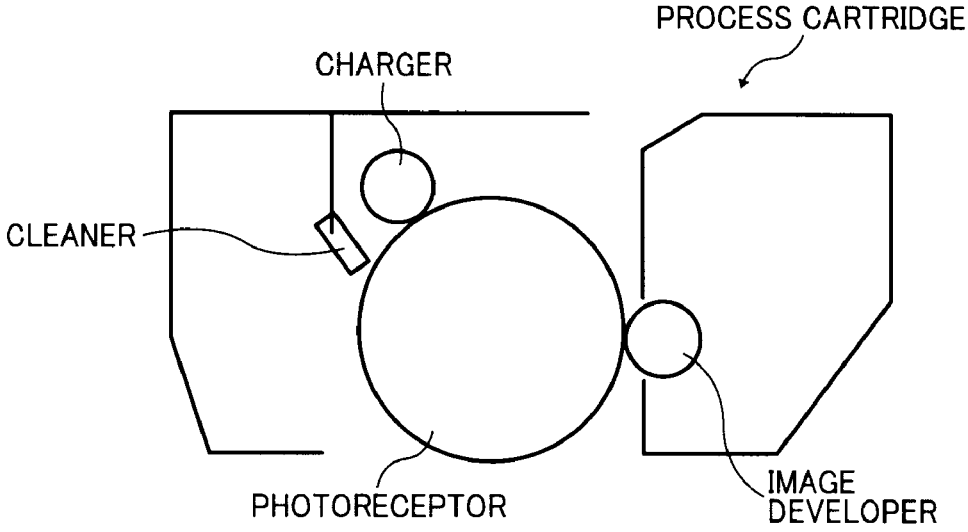
FIG. 7 is a schematic cross-sectional view illustrating a configuration of a process cartridge.

FIG. 7 is a schematic cross-sectional view illustrating an embodiment of configuration of a process cartridge usable in the image forming apparatus of the present invention.

In FIG. 7, the process cartridge includes a photoreceptor as an electrostatic latent image bearer, a charger, an image developer and a cleaner in a body. However, the present invention is not limited thereto. Namely, the process cartridge includes an electrostatic latent image bearer and at least an image developer, and may optionally include known means such as a charger, a cleaner and a discharger.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

When evaluating images with a two-component developer, 100 parts of a ferrite carrier having an average particle diameter of 35 μm, coated with a silicone resin layer having an average thickness of 0.5 μm, and 7 parts of each color toner were uniformly mixed in a Turbular Mixer to form a two-component developer as follows.

The following coating materials were dispersed by a stirrer for 10 min to prepare a coating liquid.

| | |
|---|---|
| Toluene | 450 |
| Silicone resin<br>SR2400 having a nonvolatile matter of 50% from Dow Corning Toray Silicone Co., Ltd. | 450 |
| Amino silane<br>SH6020 from Dow Corning Toray Silicone Co., Ltd. | 10 |
| Carbon black | 10 |

The coating liquid was coated on the following core material by a coater coating while forming a spiral flow with a rotational bottom board disc and a stirring blade in a fluidizing bed.

| | |
|---|---|
| Mn Ferrite particle<br>having a weight-average particle diameter of 35 μm | 5,000 |

The coated material was calcined in an electric oven at 250° C. for 2 hrs to prepare a carrier.

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 3,500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 3 hrs at 75° C. to prepare an aqueous dispersion [particulate dispersion 1]. The [particulate dispersion 1] was measured by LA-920 to find a volume-average particle diameter thereof was 120 nm.

990 parts of water, 83 parts of the [particulate dispersion 1], 40 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid an [aqueous phase 1].

220 parts of an adduct of bisphenol A with 2 moles of ethyleneoxide, 560 parts of an adduct of bisphenol A with 3 moles of propyleneoxide, 218 parts terephthalic acid, 48 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 45 parts of trimellitic acid anhydride were added thereto and the mixture was reacted for 4 hrs at a normal pressure and 170° C. to prepare a [low-molecular-weight polyester 1].

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs to prepare an [intermediate polyester 1].

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

75 moles of 1,4-butanediol, 71.25 moles of fumaric acid, 4.95 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

170 parts of isophoronediamine and 75 parts of methyl ethyl ketone were reacted at 50° for 5 hrs in a reaction vessel including a stirrer and a thermometer to prepare a [ketimine compound 1]. The [ketimine compound 1] had an amine value of 418.

40 parts of carbon black REGAL 400R from Cabot Corp., 60 parts of a binder resin, i.e., a polyester resin RS-801 having an acid value of 10, a Mw of 20,000 and a Tg of 64° C., 30 parts of the crystalline polyester resin and 30 parts of water were mixed by a HENSCHEL mixer to prepare a water-logged pigment agglomerate. This was kneaded by a two-roll mil having a surface temperature of 130° C. for 1 hr, cooled and pulverized by a pulverizer to prepare a [masterbacth 1] having a particle diameter of 1 mm.

378 parts of the [low-molecular-weight polyester 1], 110 parts of carnauba wax, 22 parts of a charge controlling agent (salicylic acid metal complex E-84 from Orient Chemical Industries, Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [masterbatch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for 1 pass under the same conditions to prepare a [pigment and wax dispersion liquid 1].

648 parts of the [pigment and wax dispersion liquid 1], 30 parts of the [prepolymer 1] and 6.6 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 13,000 rpm for 20 min to prepare an [emulsified slurry 1].

1,000 parts of the [emulsified slurry 1] were mixed in an aqueous solution including 1,365 parts of ion-exchanged water and 35 parts carboxymethylcellulose CMC DAICEL-1280 from DAICEL CHEMICAL INDUSTRIES, LTD. by a TK-type homomixer from Tokushu Kika Kogyo Co., Ltd. at 2,000 rpm for 1 hr to prepare a [deformed slurry 1].

The [deformed slurry 1] was placed in a vessel including a stirrer and a thermometer, a solvent was removed therefrom at 30° C. for 8 hrs and the slurry was aged at 45° C. for 4 hrs to prepare a [dispersion slurry 1].

After 100 parts of the [dispersion slurry 1] was filtered under reduced pressure to prepare a filtered cake, 100 parts of ion-exchanged water were added to the filtered cake and mixed by the TK-type homomixer at 12,000 rpm for 10 min, and the mixture was filtered.

Further, 100 parts of an aqueous solution of 10% sodium hydrate were added to the filtered cake and mixed by the TK-type homomixer at 12,000 rpm for 10 min upon application of ultrasonic vibration, and the mixture was filtered under reduced pressure. This ultrasonic alkaline washing was performed again (Two ultrasonic alkaline washings).

Further, 100 parts of 10% hydrochloric acid were added to the filtered cake and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered. This operation was repeated again to prepare a filtered cake 1. The filtered cake 1 was dried by an air drier at 45° C. for 48 hrs and sieved by a mesh having an opening of 75 μm to prepare parent toner particles 1.

Finally, 1 part of hydrophobic silica and 0.5 parts of hydrophobic titanium oxide were mixed with 100 parts of the [mother toner particles 1] by aHENSCHELMIXER to prepare a toner. Properties of the toner are shown in Table 1 and the results of evaluation thereof are shown in Table 2.

Example 2

The procedure for preparation of the toner in Example 1 was repeated except for changing the particulate dispersion 1 and the crystalline polyester resin as follows. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 12 hrs at 65° C. to prepare an aqueous dispersion [particulate dispersion 2]. The [particulate dispersion 2] was measured by LA-920 to find a volume-average particle diameter thereof was 510 nm.

75 moles of 1,4-butanediol, 71.25 moles of fumaric acid, 15 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

Example 3

The procedure for preparation of the toner in Example 1 was repeated except for changing the amount of the [masterbatch 1] from 500 to 700 to prepare the [material solution 1]. Properties of the toner are shown in Table 1 and the results of evaluation thereof are shown in Table 2.

Example 4

The procedure for preparation of the toner in Example 1 was repeated except for changing the particulate dispersion 1 and the crystalline polyester resin as follows, and the amount of the [masterbatch 1] from 500 to 700 to prepare the [material solution 1]. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 12 hrs at 65° C. to prepare an aqueous dispersion [particulate dispersion 3]. The [particulate dispersion 3] was measured by LA-920 to find a volume-average particle diameter thereof was 510 nm.

75 moles of 1,4-butanediol, 71.25 moles of fumaric acid, 15 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

Example 5

The procedure for preparation of the toner in Example 1 was repeated except for replacing the [prepolymer 1] with the [low-molecular-weight polyester 1] to prepare an [emulsified slurry 2], and changing the particulate dispersion 1 and the crystalline polyester resin as follows. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 12 hrs at 65° C. to prepare an aqueous dispersion [particulate dispersion 4]. The [particulate dispersion 4] was measured by LA-920 to find a volume-average particle diameter thereof was 510 nm.

75 moles of 1,4-butanediol, 71.25 moles of fumaric acid, 15 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

Example 6

The procedure for preparation of the toner in Example 1 was repeated except for replacing the [prepolymer 1] with the [low-molecular-weight polyester 1] to prepare an [emulsified slurry 3]. Properties of the toner are shown in Table 1 and the results of evaluation thereof are shown in Table 2.

Example 7

The procedure for preparation of the toner in Example 1 was repeated except for replacing the [prepolymer 1] with the [low-molecular-weight polyester 1] to prepare an [emulsified slurry 4], and changing the amount of the [masterbatch 1] from 500 to 700 to prepare the [material solution 2]. Properties of the toner are shown in Table 1 and the results of evaluation thereof are shown in Table 2.

Example 8

The procedure for preparation of the toner in Example 1 was repeated except for changing the particulate dispersion 1 and the crystalline polyester resin as follows, the amount of the [masterbatch 1] from 500 to 700 to prepare the [material solution 1], and replacing the [prepolymer 1] with the [low-molecular-weight polyester 1] to prepare an [emulsified slurry 5]. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 12 hrs at 65° C. to prepare an aqueous dispersion [particulate dispersion 5]. The [particulate dispersion 5] was measured by LA-920 to find a volume-average particle diameter thereof was 510 nm.

75 moles of 1,4-butanediol, 71.25 moles of fumaric acid, 15 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

Comparative Example 1

The procedure for preparation of the toner in Example 1 was repeated except for excluding the crystalline polyester resin to prepare the [masterbatch 1]. Properties of the toner are shown in Table 1 and the results of evaluation thereof are shown in Table 2.

Comparative Example 2

The procedure for preparation of the toner in Example 1 was repeated except for changing the particulate dispersion 1 and the crystalline polyester resin as follows. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 5 hrs at 75° C. to prepare an aqueous dispersion [particulate dispersion 6]. The [particulate dispersion 6] was measured by LA-920 to find a volume-average particle diameter thereof was 230 nm.

75 moles of 1,4-butanediol, 71.25 moles of fumaric acid, 15 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

Comparative Example 3

The procedure for preparation of the toner in Example 1 was repeated except for changing the particulate dispersion 1, the low-molecular-weight polyester 1 and the emulsified slurry 1 as follows, and excluding the crystalline polyester resin. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 5 hrs at 75° C. to prepare an aqueous dispersion [particulate dispersion 7]. The [particulate dispersion 7] was measured by LA-920 to find a volume-average particle diameter thereof was 230 nm.

220 parts of an adduct of bisphenol A with 2 moles of ethyleneoxide, 560 parts of an adduct of bisphenol A with 3 moles of propyleneoxide, 218 parts terephthalic acid, 48 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 55 parts of trimellitic acid anhydride were added thereto and the mixture was reacted for 12 hrs at a normal pressure and 165° C. to prepare a [low-molecular-weight polyester 2].

648 parts of the [pigment and wax dispersion liquid 1], parts of the [prepolymer 1] and 6.6 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 13,000 rpm for 20 min to prepare an [emulsified slurry 2].

Comparative Example 4

The procedure for preparation of the toner in Example 1 was repeated except for changing the particulate dispersion 1, the emulsified slurry 1 and the crystalline polyester resin as follows. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 12 hrs at 65° C. to prepare an aqueous dispersion [particulate dispersion 8]. The [particulate dispersion 8] was measured by LA-920 to find a volume-average particle diameter thereof was 530 nm.

648 parts of the [pigment and wax dispersion liquid 1], 150 parts of the [prepolymer 1] and 6.6 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 13,000 rpm for 20 min to prepare an [emulsified slurry 3].

75 moles of 1,4-butanediol, 71.25 moles of fumaric acid, 15 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

Comparative Example 5

The procedure for preparation of the toner in Example 1 was repeated except for changing the particulate dispersion 1 and the low-molecular-weight polyester 1. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 12 hrs at 65° C. to prepare an aqueous dispersion [particulate dispersion 9]. The [particulate dispersion 9] was measured by LA-920 to find a volume-average particle diameter thereof was 510 nm.

220 parts of an adduct of bisphenol A with 2 moles of ethyleneoxide, 560 parts of an adduct of bisphenol A with 3 moles of propyleneoxide, 218 parts terephthalic acid, 48 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 55 parts of trimellitic acid anhydride were added thereto and the mixture was reacted for 12 hrs at a normal pressure and 165° C. to prepare a [low-molecular-weight polyester 3].

Comparative Example 6

The procedure for preparation of the toner in Example 1 was repeated except for changing the particulate dispersion 1, the emulsified slurry 1 and the crystalline polyester resin as follows, and changing the amount of the [masterbatch 1] from 500 to 800 to prepare the [material solution 3]. Properties of the toner are shown in Table 1 and the results of evaluation thereof are shown in Table 2.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 500 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was aged for 5 hrs at 75° C. to prepare an aqueous dispersion [particulate dispersion 10]. The [particulate dispersion 10] was measured by LA-920 to find a volume-average particle diameter thereof was 230 nm.

648 parts of the [pigment and wax dispersion liquid 1], 150 parts of the [prepolymer 1] and 6.6 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 13,000 rpm for 20 min to prepare an [emulsified slurry 4].

75 moles of 1,4-butanediol, 71.25 moles of fumaric acid, 20 moles of trimellitic acid anhydride and 15.9 g of hydroquinone were reacted in a reactor vessel including a cooling pipe, a stirrer and a nitrogen inlet pipe at 160° C. for 4 hrs, 200° C. for 2 hrs, and further at 8.3 KPa for 1 hr to prepare a crystalline polyester resin.

(Evaluation Items)

1) Low-Temperature Fixability

Imagio Neo 450 from Ricoh Company, Ltd. was modified to use a belt fixing method, and solid images were produced on plain papers TYPE 600 from Ricoh Company, Ltd. so that a toner adheres thereto in an amount of 0.85±0.1 mg/cm$^2$. The temperature of the fixing belt was varied to measure a fixable minimum temperature. The fixable minimum temperature is a temperature of the fixing member, at which a residual ratio of image density after a fixed image is scraped with a pat is not less than 70%.

Not higher than 110° C.: very good

Higher than 110° C. and not higher than 120° C.: good

Higher than 120° C. and not higher than 130° C.: poor

Higher than 130° C.: very poor

2) Heat-Resistant Storage Stability 10 g of each toner were placed in a glass bottle having a capacity of 20 ml, the glass bottle was tapped for 100 times and left for 24 hrs in a constant temperature reservoir at 55° C. and 80% Rh to measure a penetration with a penetrometer.

Longer than 20 mm: Very good 15 mm to 20 mm: good 10 mm to 15 mm: poor

Shorter than 10 mm: very poor

3) Image Quality (Granularity and Sharpness)

ImagioNeo C600 was modified to use an oilless fixing method and single-colored photographic images were produced thereby to visually evaluate granularity and sharpness thereof.

As good as offset printing: very good

Slightly worse than offset printing: good

Considerably worse than offset printing: poor

As bad as conventional electrophotographic images: very poor

TABLE 1

| | DSC | Flow Tester | | | Particle Diameter | | Shape Factors | |
|---|---|---|---|---|---|---|---|---|
| | 1stTg | T½ | ΔTs | Ts | D4 | D4/Dn | SF-1 | SF-2 |
| Example 1 | 64 | 101 | 4.6 | 69.6 | 4.5 | 1.13 | 125 | 119 |
| Example 2 | 61 | 113 | 3.7 | 75.0 | 5.9 | 1.23 | 141 | 137 |
| Example 3 | 59 | 99 | 2.8 | 74.3 | 5.6 | 1.16 | 124 | 116 |
| Example 4 | 63 | 110 | 1.2 | 77.1 | 5.1 | 1.21 | 127 | 115 |
| Example 5 | 58 | 115 | 4.6 | 67.7 | 5.6 | 1.20 | 116 | 119 |

TABLE 1-continued

| | DSC | Flow Tester | | | Particle Diameter | | Shape Factors | |
|---|---|---|---|---|---|---|---|---|
| | 1stTg | T½ | ΔTs | Ts | D4 | D4/Dn | SF-1 | SF-2 |
| Example 6 | 68 | 121 | 3.2 | 70.2 | 5.8 | 1.22 | 113 | 115 |
| Example 7 | 56 | 96 | 2.9 | 72.4 | 6.1 | 1.19 | 121 | 114 |
| Example 8 | 60 | 108 | 1.1 | 75.3 | 6.3 | 1.23 | 118 | 119 |
| Comparative Example 1 | 56 | 121 | 6.9 | 67.1 | 5.8 | 1.09 | 133 | 124 |
| Comparative Example 2 | 53 | 114 | 4.3 | 66.4 | 6.6 | 1.14 | 149 | 142 |
| Comparative Example 3 | 69 | 128 | 4.7 | 81.3 | 7.3 | 1.33 | 151 | 131 |
| Comparative Example 4 | 76 | 124 | 4.8 | 80.3 | 7.8 | 1.27 | 138 | 145 |
| Comparative Example 5 | 62 | 94 | 2.5 | 66.4 | 6.3 | 1.18 | 126 | 149 |
| Comparative Example 6 | 74 | 112 | 0.8 | 79.3 | 4.2 | 1.40 | 153 | 152 |

TABLE 2

| | Low-temperature fixability | Heat-resistant storage stability | Image quality |
|---|---|---|---|
| Example 1 | Very good | Good | Good |
| Example 2 | Good | Good | Good |
| Example 3 | Very good | Very good | Very good |
| Example 4 | Very good | Very good | Good |
| Example 5 | Good | Good | Good |
| Example 6 | Good | Very good | Good |
| Example 7 | Very good | Good | Good |
| Example 8 | Very good | Very good | Good |
| Comparative Example 1 | Good | Very poor | Poor |
| Comparative Example 2 | Good | Very poor | Poor |
| Comparative Example 3 | Very poor | Good | Very poor |
| Comparative Example 4 | Poor | Good | Poor |
| Comparative Example 5 | Good | Good | Very poor |
| Comparative Example 6 | Very poor | Very poor | Very poor |

From the above-mentioned evaluation results of Examples 1 to 8 and Comparative Examples 1 to 6, the toner of the present invention has low-temperature fixability and good heat-resistant storage stability, and produces high-quality images.

This application claims priority and contains subject matter related to Japanese Patent Applications Nos. 2009-140257 and 2010-112184, filed on Jun. 11, 2009, and May 14, 2010, respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by letters patent of the United States is:

1. A toner for developing electrostatic latent images, the toner comprising:

a binder resin;

a colorant; and a release agent, wherein the toner has a glass transition temperature (Tg) of from 55 to 75° C., a melting point (T1/2) of from 95 to 125° C. as measured by a flow tester in a ½ method, and ΔTs of from 1 to 5° C., wherein ΔTs is defined by the following formula:

$$\Delta Ts = Ts - T(Ls/2),$$

wherein Ts is a softening point of the toner; T(Ls/2) is a temperature when a stroke is Ls/2; and Ls is a stroke (mm) at Ts, and wherein the toner is prepared by a solution suspension method.

2. The toner of claim 1, wherein the binder resin comprises a crystalline polyester resin.

3. The toner of claim 1, wherein the toner has ΔTs of from 1 to 3° C.

4. The toner of claim 1, wherein the toner is granulated in an aqueous medium.

5. The toner of claim 1, wherein the toner is prepared by solution suspension with an elongation reaction.

6. The toner of claim 1, wherein the Ts is from 67 to 80° C.

7. The toner of claim 1, wherein the toner has a weight-average particle diameter (D4) of from 2 to 7 μm and a ratio (D4/Dn) of the weight-average particle diameter (D4) to a number-average particle diameter not greater than 1.25.

8. The toner of claim 1, wherein the toner has shape factors SF-1 of from 100 to 150 and SF-2 of from 100 to 140.

9. A two-component developer, comprising the toner according to claim 1 and a magnetic carrier.

10. An image forming apparatus, comprising:

an electrostatic latent image bearer configured to bear an electrostatic latent image;

an image developer configured to develop the electrostatic latent image with the two-component developer according to claim 9 to form a toner image; and a transferer configured to electrostatically transfer the toner image onto a transfer material.

11. The image forming apparatus of claim 10, further comprising a process cartridge comprising the electrostatic latent image bearer and at least the image developer integrated in a single body.

12. The image forming apparatus of claim 10, further comprising a fixer configured to fix the toner image on the transfer material, wherein the fixer comprises:

a heating element;

a belt-shaped heat-transfer medium heated by the heating element; and a pressure member configured to contact the transfer material to the heat-transfer medium upon application of pressure.

13. The image forming apparatus of claim 12, wherein the pressure member contacts the transfer material to the heat-transfer medium at a surface pressure of from 10 to 80 N/cm$^2$.

14. An image forming method, comprising:

forming an electrostatic latent image on an electrostatic latent image bearer;

developing the electrostatic latent image with the two-component developer according to claim 9 to form a toner image; and electrostatically transferring the toner image onto a transfer material.

15. A toner for developing electrostatic latent images, the toner comprising:

a core binder resin;

a colorant; and a release agent, wherein the toner has a core-shell structure, wherein a shall layer is composed of at least one organic particulate material formed around the core binder resin, wherein the toner has a glass transition temperature (Tg) of from 55 to 75° C., a melting point (T1/2) of from 95 to 125° C. as measured by a flow tester in a ½ method, and ΔTs of from 1 to 5° C., wherein ΔTs is defined by the following formula:

$$\Delta Ts = Ts - T(Ls/2),$$

wherein Ts is a softening point of the toner; T(Ls/2) is a temperature when a stroke is Ls/2; and Ls is a stroke (mm) at Ts, and wherein the toner is prepared by a solution suspension method.

16. The toner of claim 15, wherein the binder resin comprises a crystalline polyester resin.

17. The image forming apparatus of claim 16, wherein the binder resin comprises an amorphous polyester resin.

18. The image forming apparatus of claim 15, wherein the at least one organic particulate material has a diameter of from 100 to 500 nm.

19. The toner of claim 15, wherein the toner has a weight-average particle diameter (D4) of from 2 to 7 μm and a ratio (D4/Dn) of the weight-average particle diameter (D4) to a number-average particle diameter not greater than 1.25.

20. The toner of claim 15, wherein the toner has shape factors SF-1 of from 100 to 150 and SF-2 of from 100 to 140.

* * * * *